US007419752B2

(12) United States Patent
Wu et al.

(10) Patent No.: US 7,419,752 B2
(45) Date of Patent: Sep. 2, 2008

(54) IMAGING MEMBER HAVING POLYVINYLIDENE CHLORIDE BARRIER POLYMER RESINS

(75) Inventors: Jin Wu, Webster, NY (US); Linda L. Ferrarese, Rochester, NY (US); James R. Beckus, Webster, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 341 days.

(21) Appl. No.: 11/256,811

(22) Filed: Oct. 24, 2005

(65) Prior Publication Data

US 2007/0092815 A1 Apr. 26, 2007

(51) Int. Cl.
*G03G 5/05* (2006.01)
*G03G 5/047* (2006.01)
*G03G 5/147* (2006.01)

(52) U.S. Cl. ..... 430/59.6; 430/59.1; 430/66; 399/159

(58) Field of Classification Search ..... 430/59.6, 430/66, 59.1; 399/159
See application file for complete search history.

(56) References Cited

U.S. PATENT DOCUMENTS

| | | | | |
|---|---|---|---|---|
| 3,121,006 | A | 2/1964 | Middleton et al. | |
| 4,518,669 | A | 5/1985 | Yashiki | |
| 4,579,801 | A | 4/1986 | Yashiki | |
| 4,775,605 | A | 10/1988 | Seki et al. | |
| 5,017,449 | A | 5/1991 | Yoshihara | |
| 5,344,734 | A | 9/1994 | Monbaliu et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,665,500 | A * | 9/1997 | Suzuki | 430/58.5 |
| 5,721,080 | A | 2/1998 | Terrell et al. | |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 2003/0113642 | A1 * | 6/2003 | Kami et al. | 430/57.2 |
| 2005/0106482 | A1 * | 5/2005 | Kami et al. | 430/57.2 |
| 2006/0029870 | A1 * | 2/2006 | Nukada et al. | 430/56 |

FOREIGN PATENT DOCUMENTS

JP 2000231211 A * 8/2000

OTHER PUBLICATIONS

Product Data Sheet for IXAN PV 910 (May 2005).*
Product Data Sheet for IXAN SGA-1 (Jul. 2003).*
Product Data Sheet for IXAN PNE 613 (Mar. 2002).*
Product Data Sheet for IXAN PNE 288 (Apr. 2006).*

* cited by examiner

*Primary Examiner*—Christopher RoDee
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to a photoreceptor additive to improve impermeability to gases and moisture so as to minimize environment variation of photoreceptor performance.

13 Claims, 1 Drawing Sheet

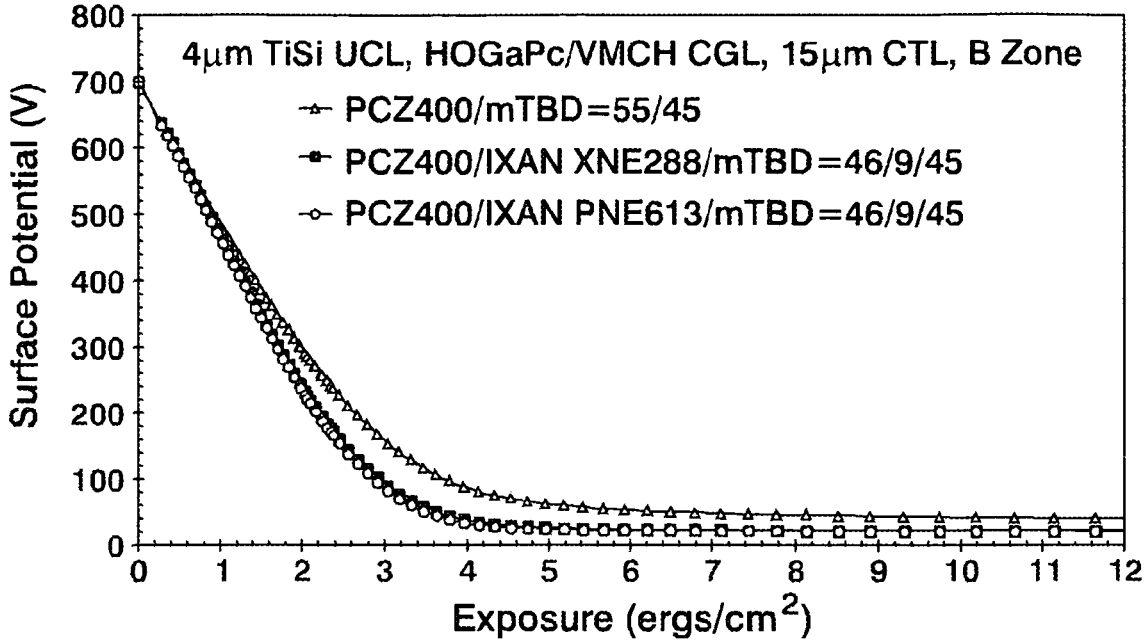
4μm TiSi UCL, HOGaPc/VMCH CGL, 15μm CTL, B Zone
PCZ400/mTBD=55/45
PCZ400/IXAN XNE288/mTBD=46/9/45
PCZ400/IXAN PNE613/mTBD=46/9/45
Surface Potential (V)
Exposure (ergs/cm2)
0
100
200
300
400
500
600
700
800
0
1
2
3
4
5
6
7
8
9
10
11
12

IMAGING MEMBER HAVING POLYVINYLIDENE CHLORIDE BARRIER POLYMER RESINS

BACKGROUND

Herein disclosed are imaging members, such as layered photoreceptor structures, and processes for making and using the same. The imaging members can be used in electrophotographic, electrostatographic, xerographic and like devices, including printers, copiers, scanners, facsimiles, and including digital, image-on-image, and like devices. More particularly, the embodiments pertain to a photoreceptor that incorporates specific polymeric resins, known as "barrier polymers," that have high impermeability to gases and moisture to minimize environment-induced variation of photoreceptor performance.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional layer and, in some belt embodiments, an anticurl backing layer. In the multilayer configuration, the active layers of the photoreceptor are the charge generation layer (CGL) and the charge transport layer (CTL). Enhancement of charge transport across these imaging layers provide better photoreceptor performance.

The demand for improved print quality in xerographic reproduction is increasing, especially with the advent of color. Common print quality issues are strongly dependent on the quality of the different photoreceptor layers. The different layers are influenced by environmental conditions, and thus, the photoreceptor performance is dependent on how the layers tolerate certain environmental conditions. For example, lower residual and sharper photoinduced discharge characteristics (PIDC) curves are usually observed in humid and warm environments, such as A zone. In contrast, higher residual and softer PIDC curves are usually observed in dry and cold environments such as C zone. More charge deficient spots (CDS) and background failure are observed in A zone, whereas more ghosting and bias charge roll (BCR) leakage breakdown failures are observed in C zone. The primary reason for this behavior is that the surface layer is susceptible to gas such as $O_2$, $O_3$, $NO_x$ and moisture permeation, which subsequently affects the lower layers, including the charge generating layers and the undercoat layers. Polycarbonate is commonly used as a top layer polymer; however, its ability to prevent gas and moisture permeation is not always sufficient.

In order to fundamentally minimize environment variation of photoreceptor performance, a barrier polymer needs to be introduced into the surface layers of the photoreceptor device. Thus, there is a need for a surface layer that has very high impermeability to gases and moisture that can insulate the lower layers from environmental influence.

The terms "charge blocking layer" and "blocking layer" are generally used interchangeably with the phrase "undercoat layer."

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein incorporated by reference in their entirety.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are herein incorporate by reference in their entirety.

SUMMARY

According to embodiments illustrated herein, there is provided a way in which print quality is improved. The embodiments can function well in many of the layers of the photoreceptor, such as the charge transport layer, overcoat layer, or other layer, for example, using photoreceptors with surface layers that exhibit high impermeability to gas and moisture.

In embodiments, there is provided an electrophotographic imaging member, comprising a substrate, an undercoat layer formed on the substrate, and at least one imaging layer formed on the undercoat layer, wherein the imaging layer is a charge transport layer comprising a barrier polymer having an oxygen transmission rate (23° C. and 0% Relative Humidity) of from about 5 to about 250 $cm^3$ $\mu m/m^2$ dbar, a water vapor transmission rate (38° C. and 90% Relative Humidity) of from about 5 to 100 $g\mu m/m^2$ d, and a high dielectric constant (20° C./1 kHz) of from about 5 to about 25.

In another embodiment, there is provided an eletrophotographic imaging member, comprising a substrate, an undercoat layer formed on the substrate, a charge generation layer formed on the undercoat layer, wherein the charge generation layer comprises a charge generating component, and a charge transport layer formed on the charge generation layer, wherein the charge transport layer comprises a barrier polymer having an oxygen transmission rate of from about 10 to about 100 $cm^3\mu m/m^2$ dbar, a water vapor transmission rate of from about 20 to about 50 gμm/m$^2$d, and a high dielectric constant of from about 8 to about 18, the barrier polymer being selected from the group consisting of chlorinated homopolymers, chlorinated copolymers, and mixtures thereof.

Also disclosed herein is an image forming apparatus for forming images on a recording medium comprising an electrophotographic imaging member having a charge retentive-surface to receive an electrostatic latent image thereon, wherein the electrophotographic imaging member comprises a substrate, an undercoat layer formed on the substrate, and at least one imaging layer formed on the undercoat layer, wherein the imaging layer is a charge transport layer comprising a barrier polymer having an oxygen transmission rate of from about 5 to about 250 cm$^3$μm/m$^2$dbar, a water vapor transmission rate of from about 5 to about 100 gμm/m$^2$.d, and a high dielectric constant of from about 5 to about 25, a development component to apply a developer material to the charge-retentive surface to develop the electrostatic latent image to form a developed image on the charge-retentive surface, a transfer component for transferring the developed image from the charge-retentive surface to another member or a copy substrate, and a fusing member to fuse the developed image to the copy substrate.

BRIEF DESCRIPTION OF THE DRAWINGS

For a better understanding, reference may be had to the accompanying FIGURE.

In the FIGURE, a graph demonstrating surface potential versus exposure by use of an embodiment of the photoreceptor illustrated herein including an outer layer having a barrier polymer is shown.

DETAILED DESCRIPTION

It is understood that other embodiments may be utilized and structural and operational changes may be made without departure from the scope of the embodiments disclosed herein.

As more advanced, higher speed electrophotographic copiers, duplicators and printers were developed; degradation of image quality was encountered during extended cycling. The complex, highly sophisticated duplicating and printing systems operating at very high speeds have placed stringent requirements including narrow operating limits on photoreceptors. Common print quality issues are strongly dependent on how environmental conditions impact the different layers of the photoreceptor. Charge deficient spots (CDS) and background failure occur in A zone conditions while ghosting and bias charge roll (BCR) leakage breakdown are problems that commonly occur in C zone. Thus, the numerous layers used in many modern photoconductive imaging members must be highly flexible, adhere well to adjacent layers, and exhibit predictable electrical characteristics within narrow operating limits to provide excellent toner images over many thousands of cycles.

The embodiments disclosed herein relate to a photoreceptor having barrier polymers incorporated into the photoreceptor surface layers, such as the charge transport layer, to significantly improve its ability to prevent gas and moisture permeation, thus minimize environment variation of photoreceptor performance. In embodiments, these barrier polymers are chlorinated polymeric resins. These attributes are achieved because the polymers have high impermeability to gases and moisture. The oxygen transmission rates (23° C. and 0 percent Relative Humidity) of the polymers vary from about 5 to about 250 cm$^3$μm/m$^2$dbar, or from about 10 to about 100 cm$^3$μm/m$^2$dbar. The water vapor transmission rates (38° C. and 90 percent Relative Humidity) of the polymers vary from about 5 to about 100 μm/m$^2$d, from about 20 to about 50 cm$^3$μm/m$^2$dbar. Furthermore, the polymers have high dielectric constants of usually at least about 5, or from about 7 to about 25, or from about 8 to about 18. In comparison, polycarbonate, a binder commonly used in photoreceptor surface layers, possesses an oxygen transmission rate above 2000 cm$^3$μm/m$^2$dbar, a water vapor transmission rate above 1500 gμm/m$^2$d, and a dielectric constant of about 3.

Typical examples demonstrated in this invention are IXAN PNE613 and XNE288 commercially available from Solvay, which are homopolymers of vinylidene chloride. The polymers have high dielectric constant (∈>10 at 20° C./1 kHz), and high impermeable to gases and moisture.

Other examples of chlorinated homopolymers include polyvinylidene chloride, chlorinated polyvinyl chloride and chlorinated polyvinylidene chloride, and the like. Examples of chlorinated copolymers include copolymers of vinylidene chloride, chlorinated vinyl chloride and chlorinated vinylidene chloride with vinylidene fluoride, tetrafluoroethylene, trifluorochloroethylene, hexafluoropropylene, and the like. The chlorinated polymeric resins can be either soluble or dispersible in the photoreceptor surface layers. Some chemical structures include the following:

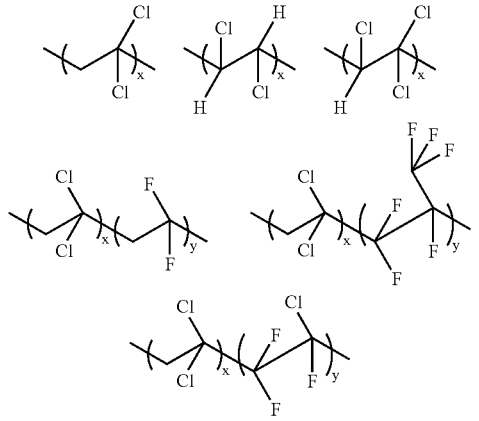

According to embodiments, an electrophotographic imaging member is provided, which generally comprises at least a substrate layer, an undercoat layer, and an imaging layer. The imaging layer may be a charge generation layer or a charge transport layer. The undercoating layer is generally located between the substrate and the imaging layer, although additional layers may be present and located between these layers and above these layers. For example there may be a conductive layer, an optional blocking layer, an optional adhesive layer, and a conductive ground strip layer adjacent to one edge of the imaging layers.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

Charge generation layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generation layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge generation layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly (vinyl carbazole), and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The charge generation layers can also fabricated by vacuum sublimation in which case there is no binder.

Any suitable and conventional technique may be used to mix and thereafter apply the charge generation layer coating mixture. Typical application techniques include spraying, dip coating, roll coating, wire wound rod coating, vacuum sublimation and the like. For some applications, the generation layer may be fabricated in a dot or line pattern. Removing of the solvent of a solvent-coated layer may be effected by any suitable conventional technique such as oven drying, infrared radiation drying, air-drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene) carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl) carbonate (also referred to as bisphenol-C-polycarbonate) and the like. Any suitable charge-transporting polymer may also be used in the charge-transporting layer of this invention. The charge-transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

Any suitable and conventional technique may be used to mix and thereafter apply the charge transport layer coating mixture to the charge generation layer. Typical application techniques include spraying, dip coating, roll coating, wire wound rod coating, and the like. Drying of the deposited coating may be effected by any suitable conventional technique such as oven drying, infrared radiation drying, air-drying and the like.

Generally, the thickness of the charge transport layer is between about 10 and about 50 micrometers, but thicknesses outside this range can also be used. The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The thickness of the continuous optional overcoat layer selected depends upon the abrasiveness of the charging (e.g., bias charging roll), cleaning (e.g., blade or web), development (e.g., brush), transfer (e.g., bias transfer roll), etc., in the system employed and can range up to about 10 micrometers. In embodiments, the thickness is from about 1 micrometer and about 5 micrometers. Any suitable and conventional technique may be used to mix and thereafter apply the overcoat layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air-drying, and the like. The dried overcoating of this invention should transport holes during imaging and should not have too high a free carrier concentration. Free carrier concentration in the overcoat increases the dark decay. In embodiments, the dark decay of the overcoated layer should be about the same as that of the unovercoated device.

The overcoat layer can comprise same ingredients as charge transport layer, wherein the weight ratio between the charge transporting small molecule and the suitable electrically inactive resin binder and is smaller, and it could be as small as 0.

In the embodiments, the charge transport layer comprises barrier polymers, such as chlorinated polymeric resins, which may provide protection to the photoreceptor layers below by insulating the undercoat layer and charge generation layer from moisture and gas permeation. Consequently, having the charge transport layer incorporated with the resins helps minimize environment variation of photoreceptor performance.

The imaging member can be employed in the imaging process of electrophotography, where the surface of an electrophotographic plate, drum, belt or the like (imaging member or photoreceptor) containing a photoconductive insulating layer on a conductive layer is first uniformly electro statically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

In various embodiments, the charge transport layer has a thickness of from about 10 μm to about 50 μm, or from about 15 μm to about 40 μm, or from about 20 μm to about 30 μm. The barrier polymer may be present in an amount of from about 1 percent to about 40 percent by weight of the total weight of the charge transport layer.

In embodiments, the barrier polymer is incorporated into the charge transport layer formulation by mixing the resin into the charge transport formulation. Some methods that can be used to incorporate the barrier polymer into a formulation to form a charge transport layer include the following: (1) simple mixing of a chlorinated polymeric resin, with a charge transport layer formulation, with the formulation being previously dispersed before adding the resin (2) ball milling a chlorinated polymeric resin with the charge transport layer formulation.

After forming the coating for the charge transport layer, the coating is applied to an imaging member substrate, over an undercoat layer formed on the substrate. The chlorinated polymeric resin in the charge transport layer may then serve as an insulator to keep out undesired moisture and gas from contacting the photoreceptor layers below the charge transport layer.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the embodiments herein. All proportions are by weight unless otherwise indicated. It will be apparent, however, that the embodiments can be practiced with many types of compositions and can have many different uses in accordance with the disclosure above and as pointed out hereinafter.

Example 1

Preparation of Photoreceptor

Three multilayered photoreceptors of the rigid drum design were fabricated by conventional coating technology with an aluminum drum of 34 millimeters in diameter as the substrate. These three drum photoreceptors contained the same undercoat layer (UCL) and charge generation layer (CGL). The only difference is that Device I contained a charge transport layer (CTL) comprising a film forming polymer binder, a charge transport compound; Device II contained the same layers as Device I except that the polyvinylidene chloride IXAN PNE613 (available from Solvay, Brussels, Belgium) was incorporated into the charge transport layer. Device III contained the same layers as Device I except that the polyvinylidene chloride IXAN XNE288 (available from Solvay, Brussels, Belgium) was incorporated into the charge transport layer.

More specifically, a titanium oxide/phenolic resin dispersion was prepared by ball milling 15 grams of titanium dioxide (STR60N™, Sakai Company), 20 grams of the phenolic resin (VARCUM™ 29159, OxyChem Company, Mw of about 3,600, viscosity of about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin were prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometers pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/Varcum™ dispersion. Additional solvents of 5 grams of 1-butanol, and 5 grams of xylene; 5.4 grams of the above prepared $SiO_2$/Varcum™ slurry were added to 50 grams of the above resulting titanium dioxide/Varcum™ dispersion, referred to as the coating dispersion. Then an aluminum drum, cleaned with detergent and rinsed with deionized water, was dip coated with the above generated coating dispersion at a pull rate of 160 millimeters/minute, and subsequently, dried at 145° C. for 45 minutes, which resulted in a so-called TiSi undercoat layer (TiSi UCL) deposited on the aluminum and comprised of $TiO_2$/$SiO_2$/Varcum™ with a weight ratio of about 60/10/40 and a thickness of 4 microns.

A 0.5 micron thick photogenerating layer was subsequently coated on top of the above generated undercoat layer from a dispersion of Type V hydroxygallium phthalocyanine (3.0 grams) and a vinyl chloride/vinyl acetate copolymer, VMCH (Mn=27,000, about 86 weight percent of vinyl chloride, about 13 weight percent of vinyl acetate and about 1 weight percent of maleic acid available from Dow Chemical (2 grams), in 95 grams of n-butyl acetate. Subsequently, a 15 μm thick charge transport layer (CTL) was coated on top of the photogenerating layer. The CTL was dried at 120° C. for 40 minutes to provide the photoreceptor device. The preparation of the CTL dispersion was described as below.

Preparation of CTL solution for Device I: The CTL solution was prepared by dissolving N,N'-diphenyl-N,N-bis(3-methylphenyl)-1,1'-biphenyl-4,4'-diamine (5.4 grams) and a film forming polymer binder PCZ-400 Mw=40,000] available from Mitsubishi Gas Chemical Company, Ltd. (6.6 grams) in a solvent mixture of 20 grams of tetrahydrofuran (THF) and 6.7 grams of toluene.

Preparation of CTL solution for Device II: The CTL solution was prepared by dissolving N,N'-diphenyl-N,N-bis(3-methylphenyl)-1,1'-biphenyl-4,4'-diamine (5.4 grams) and a film forming polymer binder PCZ-400, Mw=40,000] available from Mitsubishi Gas Chemical Company, Ltd. (6.6 grams) in a solvent mixture of 20 grams of tetrahydrofuran (THF) and 6.7 grams of toluene.

Preparation of CTL solution for Device III: The CTL solution was prepared by dissolving N,N'-diphenyl-N,N-bis(3-methylphenyl)-1,1'-biphenyl-4,4'-diamine (5.4 grams), the polyvinylidene chloride IXAN XNE288 (1.08 grams) and a film forming polymer binder PCZ400 Mw=40,000] available from Mitsubishi Gas Chemical Company, Ltd. (5.52 grams) in a solvent mixture of 20 grams of tetrahydrofuran (THF) and 6.7 grams of toluene.

Example 2

Testing of Photoreceptors

The above prepared three photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780-nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Three photoinduced discharge characteristic (PIDC) curves, shown in the accompanying FIGURE, were obtained from the two different pre-exposed surface potentials, and the data was interpolated into PIDC curves at an initial surface potential of 700 volts.

When compared with the controlled device (Device I) (same HTM loading as the charge transport layers with chlorinated polymeric resin), the devices with the chlorinated polymeric resin (Device II and III) exhibit higher sensitivity and lower residual potential. Polyvinylidene chloride as a second binder also appears to improve charge transport in the surface layer.

In addition, to show that the resins provide good photoreceptor performance even in adverse environmental conditions, a comparison was made using A zone-sensitive TiSi undercoat layer. The above photoreceptor devices were acclimated for 24 hours before testing in A-zone (85° F./80% Room Humidity). Print tests were performed in Imari Work centre using black and white copy mode to achieve machine speed of 52 mm/s. CDS levels were measured against an empirical scale, where the smaller the CDS grade level, the better the print quality. In general, a CDS grade reduction of 3 levels was observed with the chlorinated polymeric resins incorporated in the charge transport layer than the controlled photoreceptor without any chlorinated resins. As seen in Table 1, the CDS results are a clear indication that the chlorinated polymeric resin provides a barrier to moisture, and the device incorporating the resin performs much better.

| 15 μm Charge Transport Layer Device | A zone CDS at 52 mm/s |
|---|---|
| Device I | 6 |
| Device II | 3 |
| Device III | 3 |

What is claimed is:

1. An electrophotographic imaging member, comprising:

a substrate;

an undercoat layer formed on the substrate; and at least one imaging layer formed on the undercoat layer, wherein the imaging layer comprises a barrier polymer having an oxygen transmission rate of from about 5 to about 250 cm $^3$μm/m$^2$ dbar, a water vapor transmission rate of from about 5 to 100 gμm/m$^2$d, and a high dielectric constant of from about 5 to about 25, the barrier polymer comprising polyvinylidene chloride.

2. The electrophotographic imaging member of claim 1, wherein the oxygen transmission rate is from about 10 to about 100 cm$^3$μm/m$^2$dbar.

3. The electrophotographic imaging member of claim 1, wherein the water vapor transmission rate is from about 20 to 50 gμm/m$^2$d.

4. The electrophotographic imaging member of claim 1, wherein the barrier polymer has a high dielectric constant of from about 7 to about 25.

5. The electrophotographic imaging member of claim 1, wherein said imaging layer is a charge transport layer.

6. The electrophotographic imaging member of claim 5, wherein the charge transport layer has a thickness of from about 10 μm to about 50 μm.

7. The electrophotographic imaging member of claim 5, wherein the barrier polymer is present in an amount of from about 1 percent to about 40 percent by weight of the total weight of the charge transport layer.

8. The electrophotographic imaging member of claim 1, wherein said imaging layer is an overcoat layer.

9. The electrophotographic imaging member of claim 1, wherein the undercoat layer comprises titanium dioxide and silicon dioxide.

10. An electrophotographic imaging member, comprising:

a substrate;

an undercoat layer formed on the substrate;

a charge generation layer formed on the undercoat layer, wherein the charge generation layer comprises a charge generating component, and a charge transport layer formed on the charge generating layer, wherein the charge transport layer comprises a barrier polymer having an oxygen transmission rate of from about 10 to about 100 cm$^3$ μm/m$^2$dbar, a water vapor transmission rate of from about 20 to about 50 gμm/m$^2$d, and a high dielectric constant of from about 8 to about 18, the barrier polymer comprising a chlorinated homopolymer being polyvinylidene chloride.

11. The electrophotographic imaging member of claim 10, wherein the substrate is comprised of a drum or a belt, and the charge generation layer contains a hydroxygallium phthalocyanine or a chlorogallium phthalocyanine.

12. The electrophotographic imaging member of claim 10, wherein the barrier polymer is present in an amount of from about 1 percent to about 40 percent by weight of the total weight of the charge transport layer.

13. An image forming apparatus for forming images on a recording medium comprising:

a) an electrophotographic imaging member having a charge retentive-surface to receive an electrostatic latent image thereon, wherein the electrophotographic imaging member comprises a substrate, an undercoat layer formed on the substrate, and at least one imaging layer formed on the undercoat layer, wherein the imaging layer is a charge transport layer comprising a barrier polymer having an oxygen transmission rate of from about 5 to about 250 cm$_3$ μm/m$^2$dbar, a water vapor transmission rate of from about 5 to about 100 gμm$^2$d, and a high dielectric constant of from about 5 to about 25, the barrier polymer comprising polyvinylidene chloride;

b) a development component to apply a developer material to the charge-retentive surface to develop the electrostatic latent image to form a developed image on the charge-retentive surface;

c) a transfer component for transferring the developed image from the charge-retentive surface to another member or a copy substrate; and c) a fusing member to fuse the developed image to the copy substrate.

* * * * *